US006080028A

United States Patent [19]

Wen

[11] Patent Number: 6,080,028

[45] Date of Patent: Jun. 27, 2000

[54] LIFE RING/CHAIR COMBINATION

[76] Inventor: Ku-Hua Wen, No. 45, Lane 78, Chung Hsiao Street, Tainan City, Taiwan

[21] Appl. No.: 09/304,061

[22] Filed: May 4, 1999

[51] Int. Cl.[7] ..... B63B 35/76

[52] U.S. Cl. ..... 441/131

[58] Field of Search ..... 441/130, 131, 441/132, 81, 109, 110, 126, 129; 472/129; 114/346; 297/273, 276, 277, 280

[56] References Cited

U.S. PATENT DOCUMENTS

| | | | |
|---|---|---|---|
| 1,428,039 | 9/1922 | Kratz | 297/273 |
| 1,562,276 | 11/1925 | Assenzio | 441/132 |

FOREIGN PATENT DOCUMENTS

| | | | |
|---|---|---|---|
| 576709 | 4/1946 | United Kingdom | 441/131 |

*Primary Examiner*—Sherman Basinger
*Attorney, Agent, or Firm*—Rosenberg, Klein & Lee

[57] ABSTRACT

A life ring/chair combination includes a life ring with a number of annularly spaced reinforcing plates mounted thereon, a chair, and a number of connecting members for connecting the life ring with the chair. Each reinforcing plate includes a buckle ring attached thereto. The chair includes a seat and two armrests each having a number of engaging holes. Each connecting member includes an upper end with a first buckle member attached thereto for releasably engaging with an associated buckle ring. Each connecting member further includes a lower end with a second buckle member releasably engaged with an associated engaging hole.

4 Claims, 5 Drawing Sheets

LIFE RING/CHAIR COMBINATION

BACKGROUND OF THE INVENTION

1. Field of the Invention

The present invention relates to a life ring/chair combination.

2. Description of the Related Art

It is usual to put a life ring around the waist of a child for swimming safety consideration. The legs of the child are not supported in the water such that the child may feel uncomfortable. The child, even with a life ring, is still under the risk of being turned upside-down when the sea waves are strong. When a swimmer goes to the shore for rest, some seashores are not provided with chairs. The sand is too hot to sit on. An exhausted swimmer will feel very uncomfortable. The present invention is intended to provide a life ring/chair combination to solve these problems.

SUMMARY OF THE INVENTION

In accordance with a first aspect of the invention, a life ring/chair combination comprises a life ring with a plurality of annularly spaced reinforcing plates mounted thereon, a chair, and a plurality of connecting members for connecting the life ring with the chair. Each reinforcing plate includes a buckle ring attached thereto. The chair includes a seat and two armrests each having a number of engaging holes. Each connecting member includes an upper end with a first buckle member attached thereto for releasably engaging with an associated buckle ring. Each connecting member further includes a lower end with a second buckle member releasably engaged with an associated engaging hole.

In accordance with a second aspect of the invention, a life ring/chair combination comprises a life ring with a plurality of annularly spaced reinforcing plates mounted thereon, a chair, and a plurality of connecting members for connecting the life ring with the chair. Each reinforcing plate includes a buckle ring attached thereto. The chair includes a seat having a number of engaging holes. Each connecting member includes an upper end with a first buckle member attached thereto for releasably engaging with an associated buckle ring. Each connecting member further includes a lower end with a second buckle member releasably engaged with an associated engaging hole.

The seat of the chair further comprises a plurality of legs removably attached to an underside thereof. The underside of the seat includes a plurality of leg-engaging members each having a conic hole, and each leg includes an upper conic end for releasably engaging with an associated conic hole.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
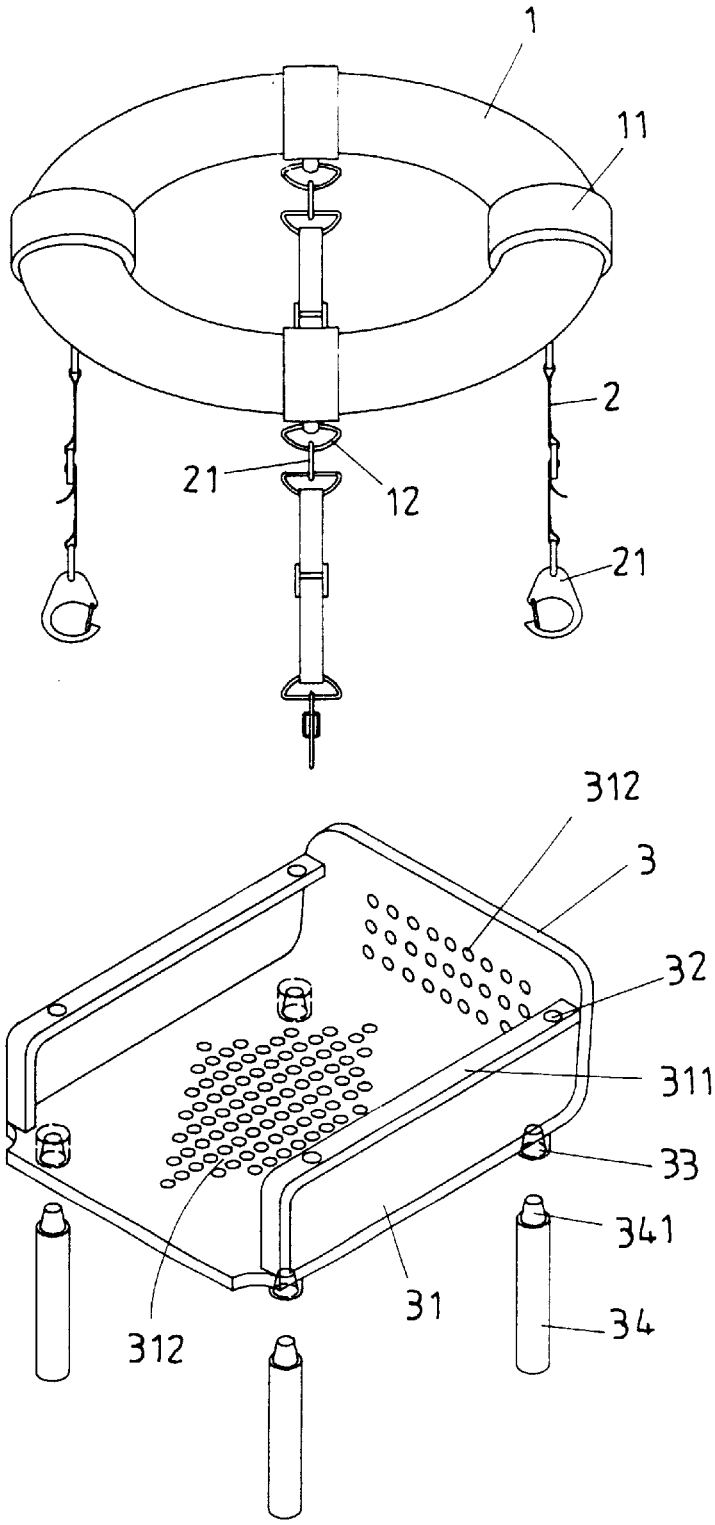
FIG. 1 is an exploded perspective view of a life ring/chair combination in accordance with the present invention.
Figure 2:
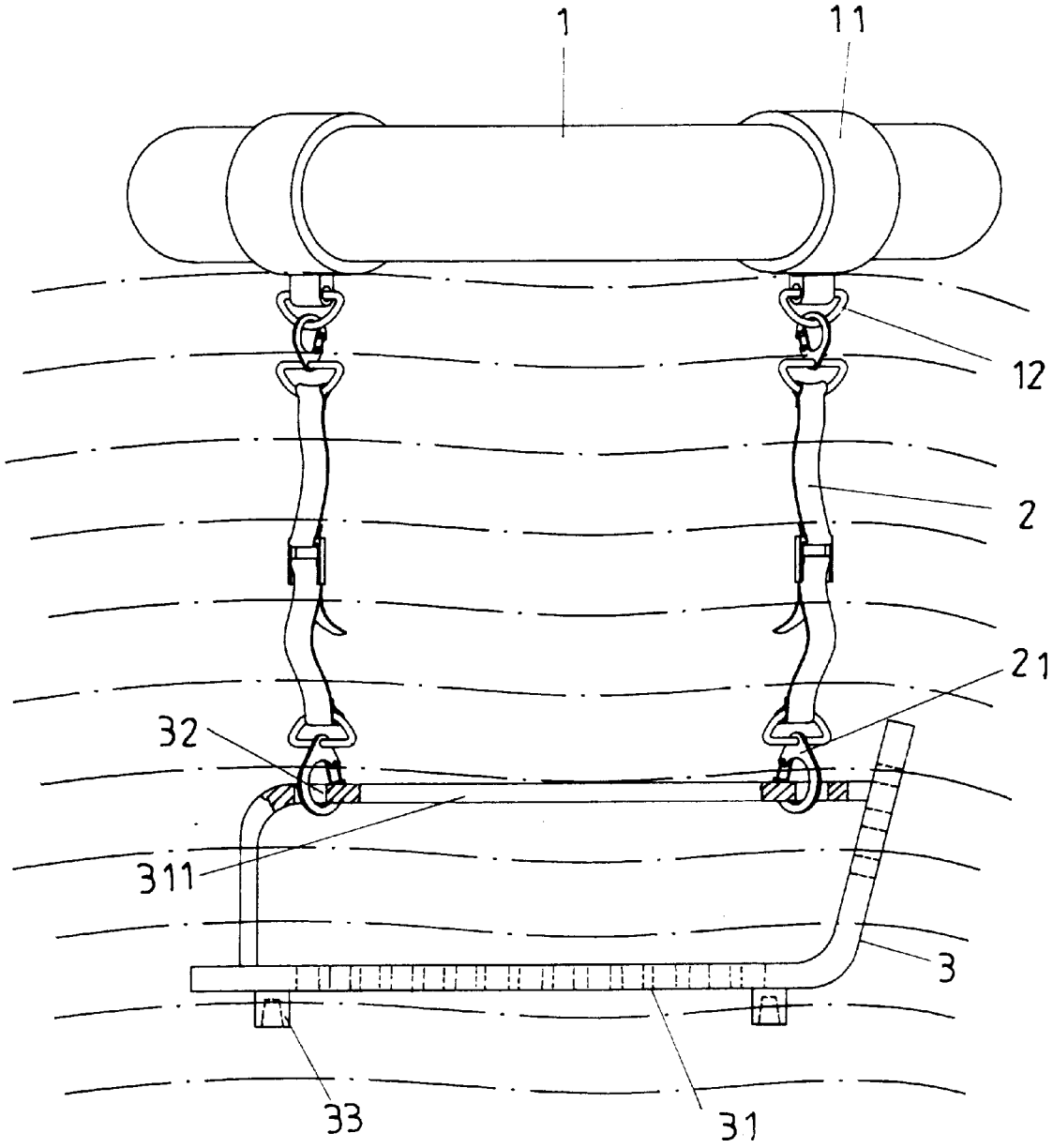
FIG. 2 is a side view of the life ring/chair combination in accordance with the present invention.
Figure 3:
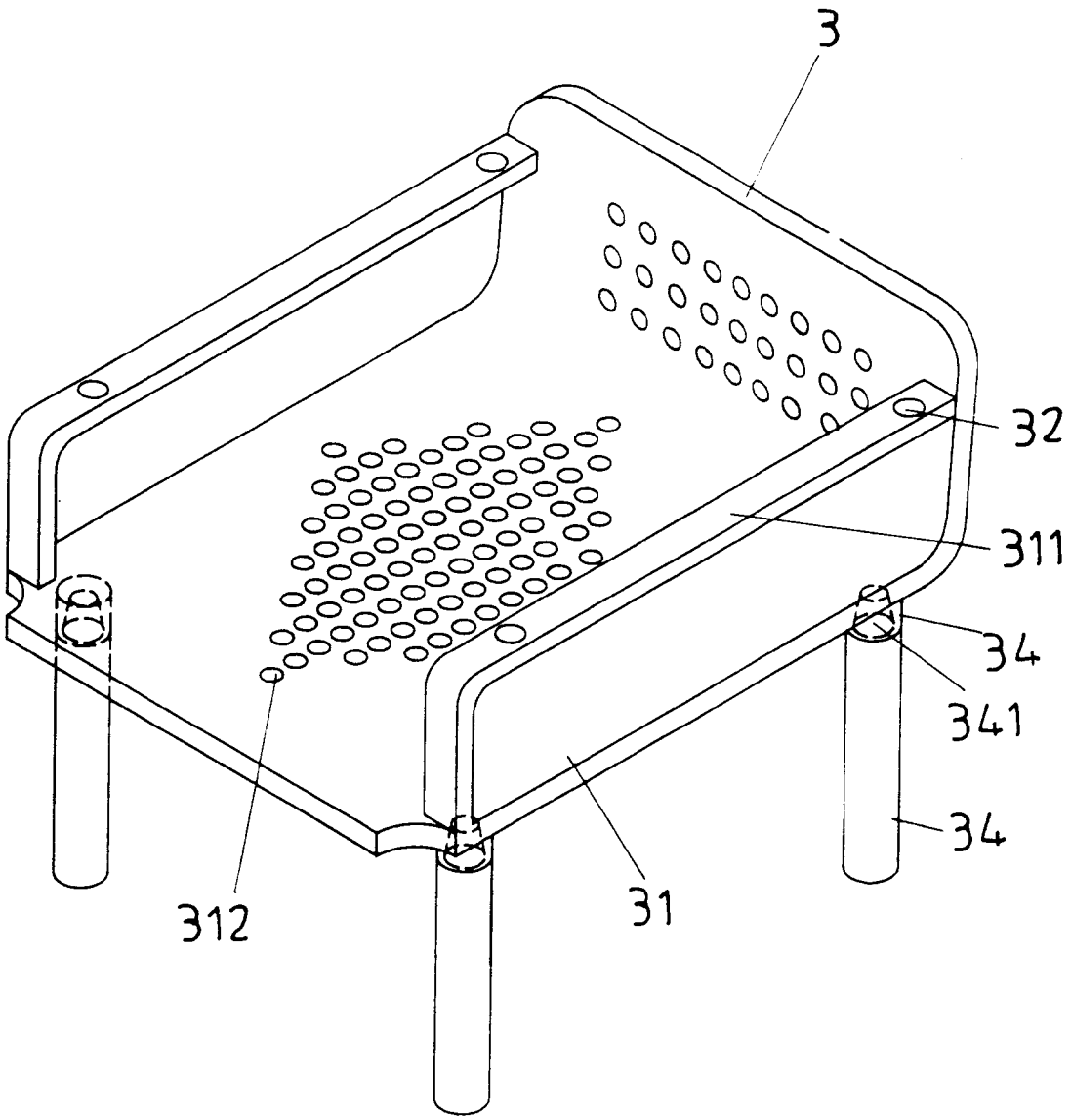
FIG. 3 is a perspective view of the chair of the life ring/chair combination in accordance with the present invention.

Referring to the drawings and initially to FIGS. 1 through 3, a life ring/chair combination in accordance with the present invention generally includes a life ring 1 with a plurality of annularly spaced reinforcing plates 11 mounted thereon, a chair 3, and a plurality of connecting members 2 for connecting the life ring 1 with the chair 3. Each reinforcing plate 11 includes a buckle ring 12 attached thereto. The chair 3 is made of light plastic material and includes a seat 31 with a plurality of openings 312, two armrests 311 each having a number of engaging holes 32, and four legs 34 removably attached to an underside of the seat 31. In this embodiment, the underside of the seat 31 includes four leg-engaging members 33 each having a conic hole (not labeled) for releasably engaging with an upper conic end 341 of an associated leg 34.

Each connecting member 2 may be a length-adjustable rope or chain and includes an upper end with a buckle member 21 attached thereto for releasably engaging with an associated buckle ring 12. A lower end of each connecting member 2 also includes a buckle member 21 for releasably engaging with an associated engaging hole 32.

Figure 4:
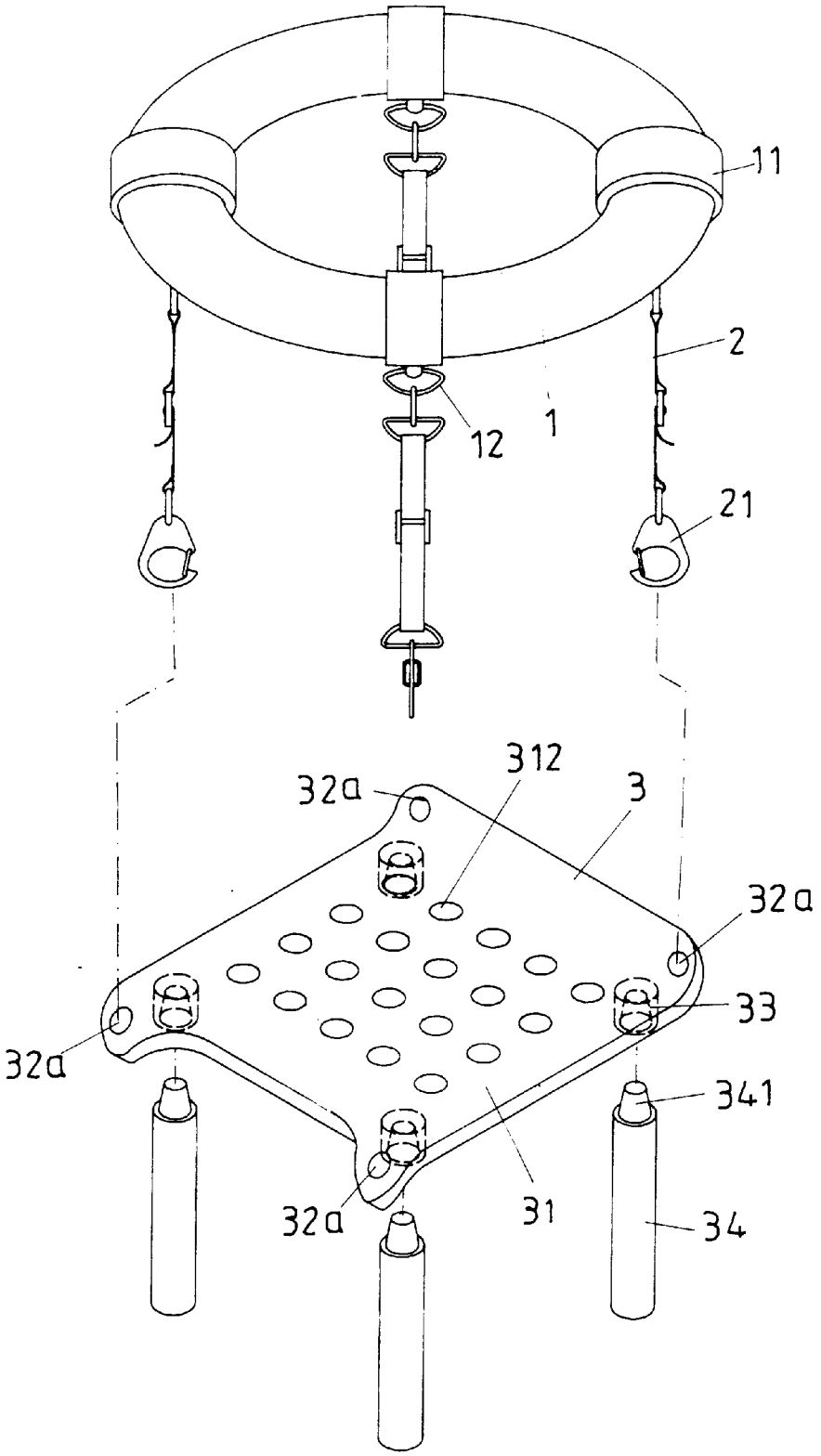
FIG. 4 is an exploded perspective view of a modified embodiment of the life ring/chair combination in accordance with the present invention.
Figure 5:
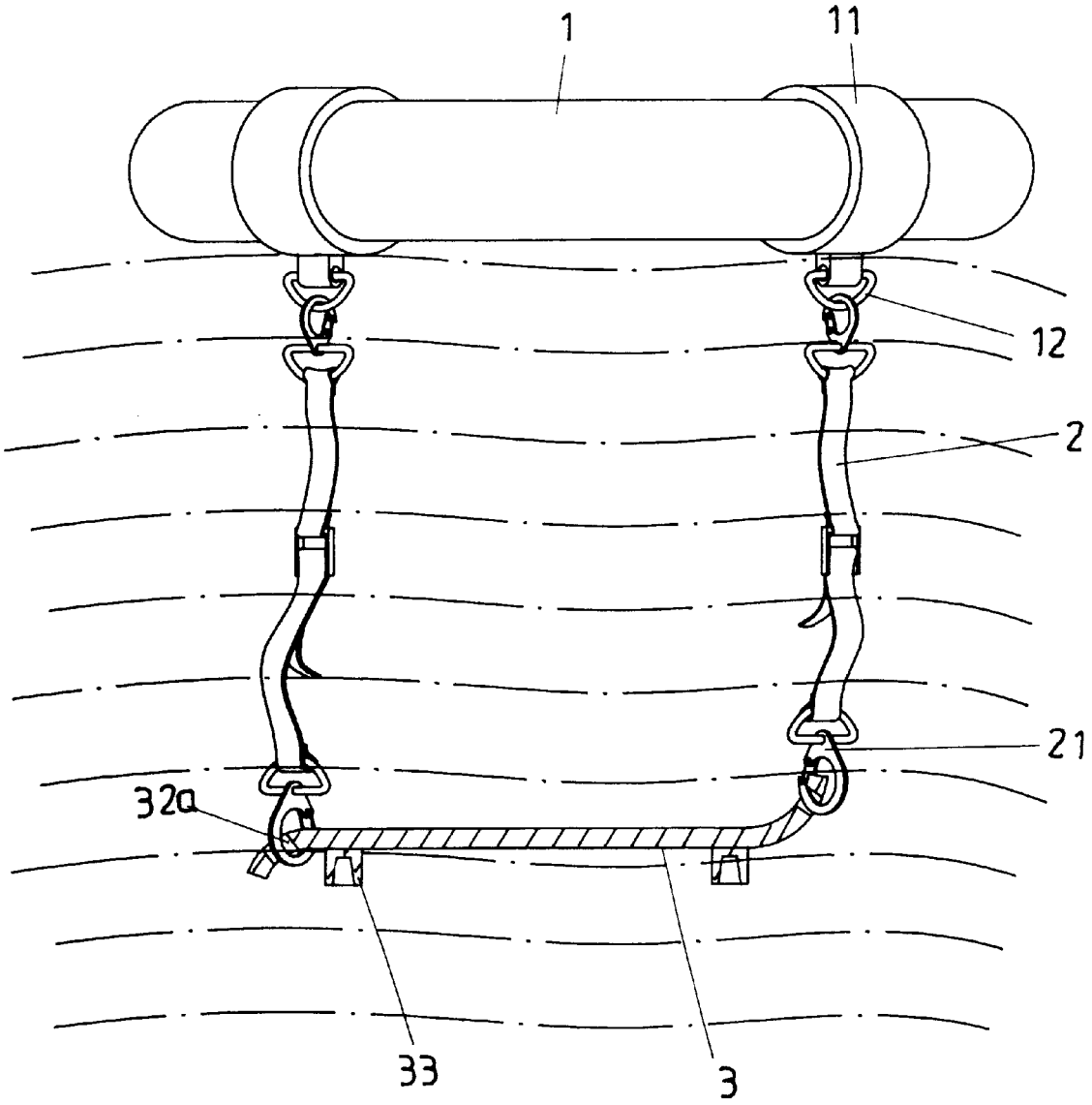
FIG. 5 is a side view of the modified life ring/chair embodiment.

FIGS. 4 and 5 illustrate a modified embodiment of the invention, wherein the armrests are omitted and the engaging holes 32*a* are directly defined in the seat 31 without adversely affecting the engaging effect.

In use, when swimming, the legs 34 are removed to reduce weight and volume, the swimmer may sit comfortably in the chair 3 and enjoy the waves, as the life ring/chair combination (without the chair legs 34) may float and sway on the waves. Water flows via the openings 312. When on the shore, the life ring 1 and the connecting members 2 are detached from the chair seat 31, and the legs 34 are attached to the seat 31 to provide a comfortable seat.

According to the above description, it is appreciated that the life ring/chair combination in accordance with the present invention provides dual functions and the assembly, detachment, and carriage thereof is easy. In addition, use of the life ring/chair combination in water is safe.

Although the invention has been explained in relation to its preferred embodiment, it is to be understood that many other possible modifications and variations can be made without departing from the spirit and scope of the invention as hereinafter claimed.

What is claimed is:

1. A life ring/chair combination comprising a life ring with a plurality of annularly spaced reinforcing plates mounted thereon, a chair, and a plurality of connecting members for connecting the life ring with the chair, each said reinforcing plate including a buckle ring attached thereto, the chair including a seat and two armrests each having a number of engaging holes, each said connecting member including an upper end with a first buckle member attached thereto for releasably engaging with an associated said buckle ring, each said connecting member further including a lower end with a second buckle member releasably engaged with an associated said engaging hole.

2. The life ring/chair combination as claimed in claim 1, wherein the seat of the chair further comprises a plurality of legs removably attached to an underside thereof, the underside of the seat including a plurality of leg-engaging members each having a conic hole, and each said leg including an upper conic end for releasably engaging with an associated said conic hole.

3. A life ring/chair combination comprising a life ring with a plurality of annularly spaced reinforcing plates mounted thereon, a chair, and a plurality of connecting members for connecting the life ring with the chair, each said reinforcing plate including a buckle ring attached thereto, the chair including a seat having a number of engaging holes, each said connecting member including an upper end with a first buckle member attached thereto for releasably engaging with an associated said buckle ring, each said connecting member further including a lower end with a second buckle member releasably engaged with an associated said engaging hole.

4. The life ring/chair combination as claimed in claim 3, wherein the seat of the chair further comprises a plurality of legs removably attached to an underside thereof, the underside of the seat including a plurality of leg-engaging members each having a conic hole, and each said leg including an upper conic end for releasably engaging with an associated said conic hole.

* * * * *